United States Patent [19]

Curd, Jr.

[11] 3,939,510

[45] Feb. 24, 1976

[54] LIGHTED PLASTIC DISCREPANCY BUOY

[76] Inventor: Robert F. Curd, Jr., Fort Marshall, Sullivans Island, S.C. 29482

[22] Filed: Nov. 7, 1974

[21] Appl. No.: 521,779

[52] U.S. Cl. ..... 9/8.3 E; 248/163

[51] Int. Cl.[2] ..... B63B 21/52; B63C 9/21

[58] Field of Search ..... 9/8.3 E, 8.3 R, 8 R, 8 P, 9/8.5, 9, 10; 248/163, 177

[56] References Cited

UNITED STATES PATENTS

| | | | |
|---|---|---|---|
| 758,218 | 4/1904 | Roberts | 9/8.3 R |
| 2,263,518 | 11/1941 | Riner | 9/8.3 E X |
| 3,071,788 | 1/1963 | Nelson | 9/8.3 E |
| 3,178,737 | 4/1965 | Brackx | 9/8 P |
| 3,276,007 | 9/1966 | White | 9/8.3 R X |
| 3,329,981 | 7/1967 | Orsino | 9/8.3 E |
| 3,335,438 | 8/1967 | Takeyasu et al. | 9/8.3 R |
| 3,604,371 | 9/1971 | Cavalucci | 248/177 X |
| 3,614,869 | 10/1971 | Flory et al. | 9/8 P X |
| 3,691,573 | 9/1972 | Laudata, Jr. | 9/8.3 E |
| 3,728,749 | 4/1973 | Eby et al. | 9/8 R |
| 3,833,955 | 9/1974 | Hulbert, Jr. | 9/8.3 E |

FOREIGN PATENTS OR APPLICATIONS

| | | | |
|---|---|---|---|
| 17,308 | 7/1915 | United Kingdom | 9/8.3 R |

*Primary Examiner*—Trygve M. Blix
*Assistant Examiner*—Douglas C. Butler
*Attorney, Agent, or Firm*—B. P. Fishburne, Jr.

[57] ABSTRACT

An essentially all-plastic lightweight buoy is ideally suitable for use as a lighted discrepancy buoy. It is resistant to sinking due to damage from water traffic, floating debris or firearms. The buoy is virtually maintenance-free. It features a relatively large disc-like flotation body having a dependent free flooding ballast tube which carries mooring elements. A vented plastic battery housing is provided on the body of the buoy above the ballast tube. An elevated lantern support and leg structure is also secured to the flotation body as a rigid unit.

4 Claims, 10 Drawing Figures

FIG. 5
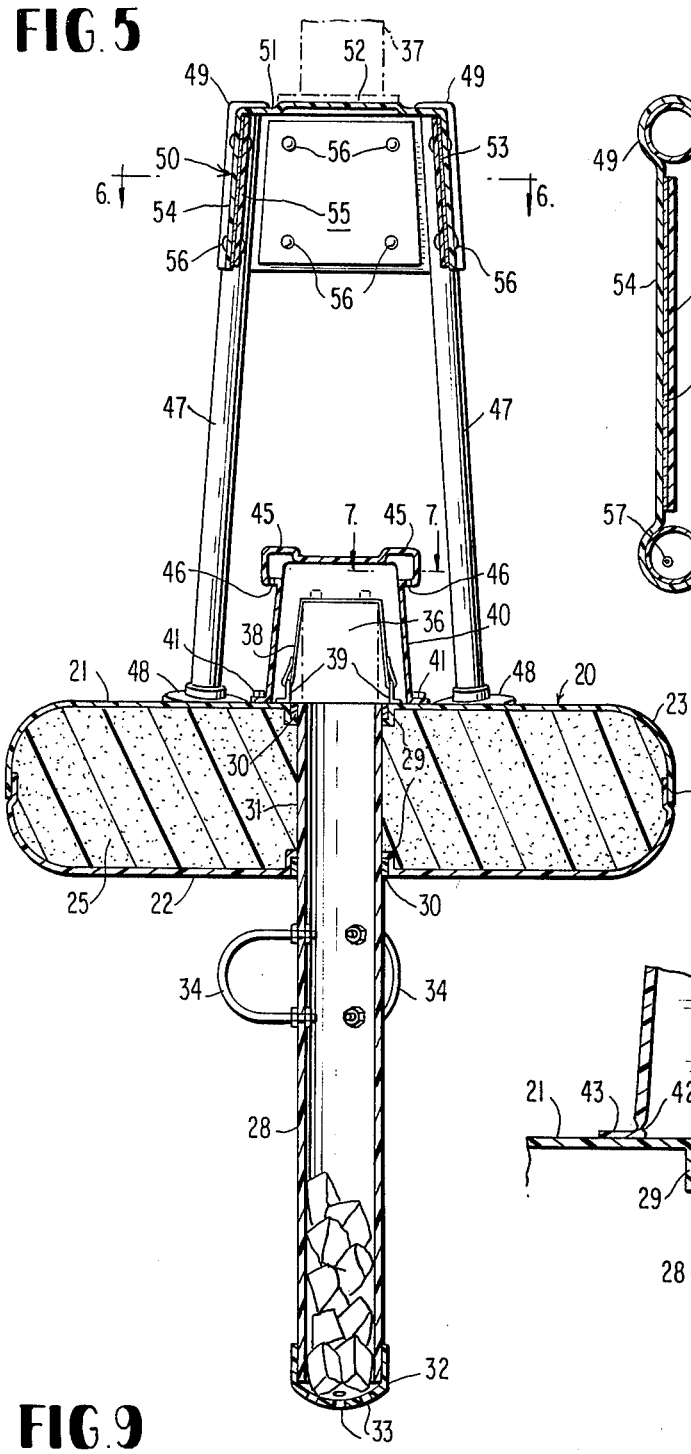
FIG. 6
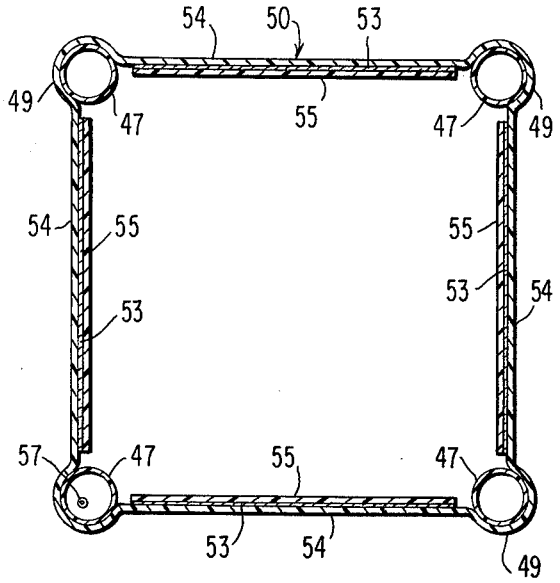
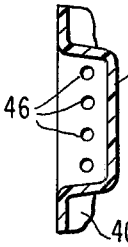
FIG. 7
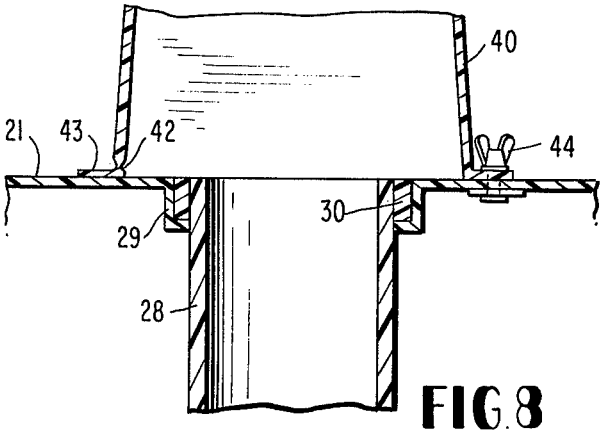
FIG. 8
FIG. 9
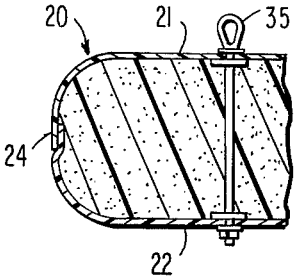
FIG. 10
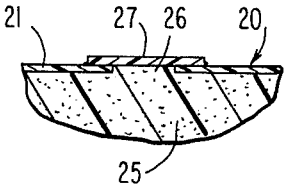

LIGHTED PLASTIC DISCREPANCY BUOY

BACKGROUND OF THE INVENTION

An urgent need exists for lightweight durable buoys which are much more economical to manufacture than existing available types. Ideally, the buoy should be virtually maintenance-free, unsinkable and highly resistant to damage caused by floating debris and water traffic. Most importantly, the buoy should be capable of being launched and retrieved by one man instead of the customary crew of three or more required to handle existing types of buoys. The plastic buoy must be capable of the same service, or better service, than conventional types and at lower cost.

By way of comparison with a well-known type of buoy widely in use, namely, the aluminum fiberglass Alerp buoy, the following statistics may be noted.

In an equivalent size for the same purpose, the aluminum fiberglass buoy costs an average of $550, compared to $350 for a plastic buoy constructed according to the invention.

The cost of maintenance of the buoy embodying the invention is reduced approximately 95 per cent compared to the maintenance cost for the aluminum fiberglass type. This conventional type of buoy requires almost constant maintenance and repair, as a result of damage caused by collision with floating objects.

Based on actual durability testing of buoy types involving dropping the structures four feet onto solid concrete, the product of the invention sustained no noticeable damage while other types were seriously damaged. The average life of the invention buoy should be five years or longer, compared to one-half or less of this useful lifetime per other known types.

Flotation tests of the invention proved equally rewarding as the buoy remained upright and high-floating at all times, whereas the aluminum fiberglass buoy was submerged in a five knot current in a debris-filled Mississippi River test.

Other detailed features and advantages of the invention will become apparent during the course of the following description.

BRIEF DESCRIPTION OF DRAWING FIGURES

FIG. 5 is an enlarged central vertical section through the buoy.

FIG. 6 is an enlarged horizontal section taken on line 6—6 of FIG. 5.

FIG. 7 is an enlarged fragmentary horizontal section taken on line 7—7 of FIG. 5.

FIG. 8 is a fragmentary vertical section taken through a modified form of battery housing.

FIG. 9 is a fragmentary vertical section through a buoy flotation body equipped with lifting eyes.

FIG. 10 is a fragmentary vertical section through the flotation body showing a plastic foam filling opening and cover plate.

DETAILED DESCRIPTION

Figure 1:
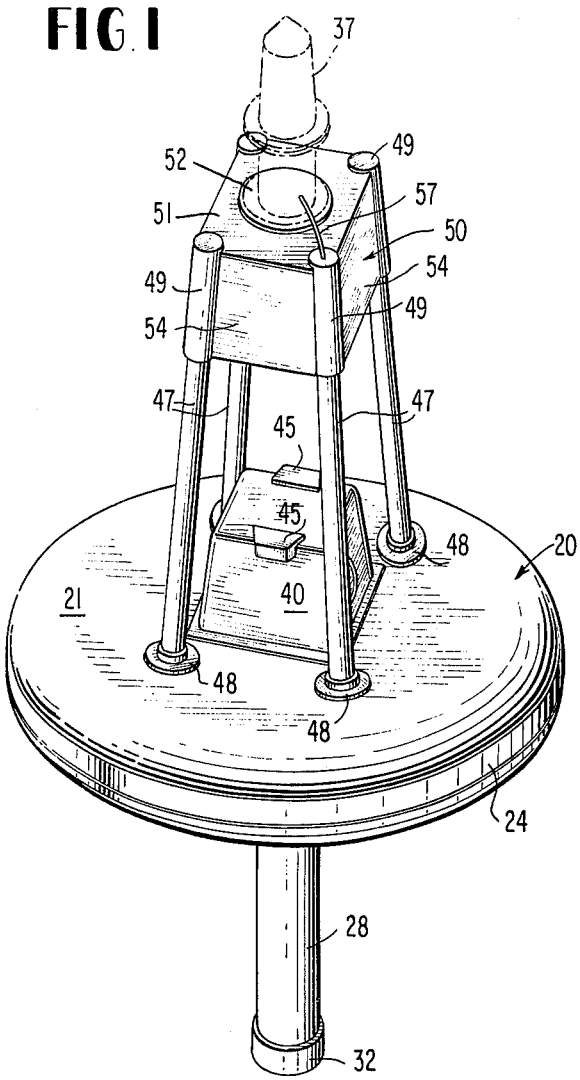
FIG. 1 is a perspective view of a buoy embodying the invention.
Figure 2:
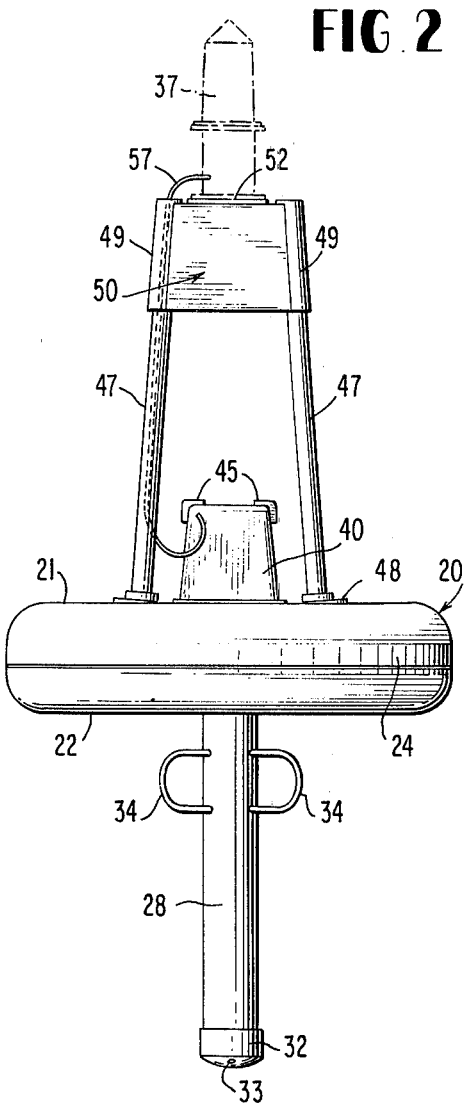
FIG. 2 is a side elevation thereof.
Figure 3:
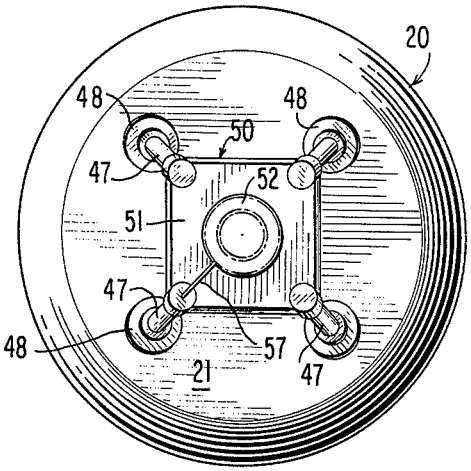
FIG. 3 is a top plan view of the buoy.
Figure 4:
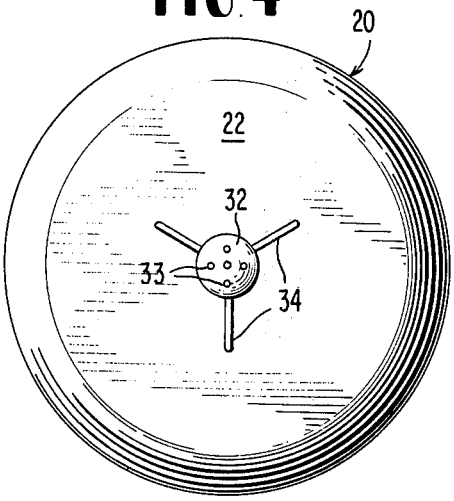
FIG. 4 is a bottom plan view thereof.

Referring to the drawings in detail, wherein like numerals designate like parts, a buoy is shown which is essentially of all-plastic construction except for certain hardware items, to be identified. The buoy comprises a preferably circular disc-like flotation body portion 20 having top and bottom shell or skin sections 21 and 22 formed of polyvinyl chloride (PVC) or acrylonitrile butadiene styrene (ABS). Such materials are very tough, abrasion-resistant, and resistant to impact. They are also effected only slightly by the weather elements and most chemicals.

As shown, the body portion 20 bounded by the shell sections 21 and 22 has parallel flat top and bottom faces and rounded annular shoulders 23 above and below a short axial cylindrical section formed by a lapped annular solvent welded joint 24 between the two shell sections. The interior space between the shell sections 21 and 22 is filled with polyurethane rigid plastic foam 25, or equivalent material, and a fill opening 26, FIG. 10, for this material is provided in one of the shell sections and is subsequently closed by a small solvent welded cover plate 27.

A ballast or stabilizing tube 28 formed of PVC or the like is received centrally and coaxially in an opening formed through the flotation body portion 20. At its top and bottom, the shell components 21 and 22 are recessed as at 29 to receive reinforcing rings 30 of PVC or equivalent material. These elements snugly embrace the upper end portion of tube 28 and the tube is cemented within the rings 29 and intervening opening 31 formed through the rigid foam core. In this manner a very secure joint or bond is produced between the flotation body 20 of the buoy and its ballast tube 28.

The lower end of tube 28 is covered by a cap 32 telescoped thereon and solvent welded thereto. This cap is apertured at 33 so that the tube 28 is free flooding and free draining. Any suitable ballast may be placed in the tube 28 and will be retained therein by the cap 32. Such ballast may be any heavy object, such as chain, window sash weights or concrete chunks.

Preferably three circumferentially equidistantly spaced U-shaped mooring bails 34 are rigidly secured in vertical planes to the central tube 28 somewhat below the body portion 20. The metal bails 34 are secured within openings in the tube wall by stainless steel nuts and split lock washers. The bails themselves are preferably formed of brass. Other forms of mooring elements may be employed in some cases.

As shown in FIG. 9, the flotation body portion 20 will normally be equipped near its periphery with plural circumferentially spaced lifting eyes 35 firmly anchored to the body portion as illustrated.

A suitable storage battery 36 for a buoy light or lantern 37 is mounted on the body portion 20 centrally and adjacent to the top of tube 28. This may be a 12 volt automotive-type battery or several dry cell batteries in a cluster. The battery is secured by a strong hold-down strap 38 whose opposite ends are attached to fixed brackets 39 secured to shell 21 with cemented rivets, not shown. A plastic battery box or housing 40 covers the battery 36 and the hold-down strap and may be bolted to the body portion 20 as indicated at 41. Alternatively, as shown in FIG. 8, the battery housing 40 may be equipped on one side with a plastic hinge 42 adjacent to a mounting flange 43 which is solvent welded to the shell 21. The opposite side of the battery housing is then secured by threaded fasteners as indicated at 44.

The battery housing 40 has a pair of vent chambers 45 on opposite sides thereof having downwardly facing air vent ports 46 which admit ventilating air while excluding water from the housing.

The buoy further comprises an elevated support for the electric lantern 37 which may be of a conventional type. The support consists of four generally vertical legs 47 formed of PVC tubing or equivalent material which converge somewhat toward their upper ends. The lower ends of these legs are socketed into plastic pipe flanges 48 which rest in premolded recesses in the top of body portion 20. The flanges 48 are cemented into these recesses and the legs 47 are cemented to the flanges. The battery housing 40 lies inside of the upper support structure symmetrically or in centered relation, as shown in the drawings.

The tops of the legs 47 are socketed securely and cemented within corner socket elements 49 of an upper enclosure 50, which is box-like and downwardly open. The enclosure 50 has a top wall 51 which directly supports the electric lantern 37 having a flange 52 bolted thereto. In addition to supporting the lantern, the box-like enclosure 50 is very rigid and serves to stabilize the support legs 47, and is very lightweight.

As depicted in FIG. 6, aluminum radar reflector panels 53 are placed on the interior faces of the side walls 54 of enclosure 50. These reflector panels are clamped in place by interior plastic plates 55 held to the walls 54 by rivets 56.

The electrical cable between the battery 36 and lantern 37 is indicated by the numeral 57, and this cable is passed through one of the tubular legs 47 as shown in the drawings to protect it from damage. Preferably a nylon stuffing tube is provided for cable entry into the battery housing 40.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A buoy comprising a substantially flat disc-like flotation body portion which is relatively thin axially and wide laterally and symmetrical about a central axis, said flotation body having a central axial bore formed entirely therethrough, a depending elongated ballast tube having an upper end portion fixedly anchored within said bore and terminating substantially at the top surface of said flotation body portion and extending for a substantial distance below said body portion to stabilize the buoy in a normal upright position, a battery housing centrally disposed on the top face of said flotation body portion immediately above and covering the top of said ballast tube, and a centrally disposed elevated light support for the buoy mounted on and extending substantially above the flotation body portion, said light support comprising paired generally vertical legs rising from said flotation body portion and having lower ends anchored to the top of said body portion, said legs symmetrically arranged about the central axis of the buoy, and a box-like reinforcing and interconnecting cap for the tops of said legs including corner substantially tubular sockets receiving upper end portions of the legs and secured thereto, whereby said cap rigidly braces all of the legs, said cap having a top wall forming a mounting seat for a light means.

2. The structure of claim 1, and a battery hold-down means on the top of the flotation body portion beneath said battery housing, said battery housing being open in its bottom to fit over and enclose a battery and said hold-down means, and said battery housing having vent opening means.

3. The structure of claim 1, and mooring elements secured to said ballast tube and spaced below the bottom of said flotation body.

4. The structure of claim 1, and said central axial bore of said flotation body portion recessed at the top and bottom faces of the body portion, and reinforcing rings in said recesses surrounding and engaging said ballast tube in axially spaced relation adjacent the top and bottom of said body portion.

* * * * *